United States Patent [19]

Le Vantine

[11] Patent Number: 4,481,691

[45] Date of Patent: Nov. 13, 1984

[54] FILM CLEANER ATTACHMENT DEVICE FOR USE WITH DISC-FILM

[76] Inventor: Allan D. Le Vantine, 18225 Rancho St., Tarzana, Calif. 91356

[21] Appl. No.: 451,483

[22] Filed: Feb. 14, 1983

[51] Int. Cl.[3] ..... B08B 5/02; B08B 6/00

[52] U.S. Cl. ..... 15/306 R; 269/63

[58] Field of Search ..... 15/306 R, 306 A, 306 B, 15/308, 310; 269/63; 354/121

[56] References Cited

U.S. PATENT DOCUMENTS 2,708,447 5/1955 Longan ..... 15/306 R X 4,395,793 8/1983 Wedel et al. ..... 15/303

*Primary Examiner*—Chris K. Moore

[57] ABSTRACT

A device which enables film cleaners, designed for cleaning strip-film, to also clean disc-film. The device consists of a spindle means, which fits through the center hole of the disc-film and holds it firmly, and a rotational means, which imparts a rotational motion to the spindle, a housing means for enclosing the mechanism, a lever means, which releases the disc-film from the spindle, and an attachment means for holding the device to the film cleaner. In the preferred embodiment, a spring mechanism means is cocked by pivoting the device on the attachment means which moves the disc-film into the jaws of the film cleaner. The spring mechanism means is released as the disc-film reaches its limit within the jaws actuating the cleaning mechanism and rotating the disc-film so that every portion of the disc-film passes through the cleaning jaws many times. Pivoting the device so that the disc-film is moved out of the jaws releases the disc-film from the spindle so that it can be removed.

9 Claims, 14 Drawing Figures

FILM CLEANER ATTACHMENT DEVICE FOR USE WITH DISC-FILM

This invention relates to the cleaning of photographic film (negative) prior to the making of a print (positive) from that film, and more specifically to a device for cleaning a new form of film, called disc-film, recently introduced by Eastman Kodak, Rochester, N.Y., in conjunction with their new disc camera.

A film-cleaner is an essential piece of equipment for film processing labs. It is used in conjunction with film printers, which make prints from developed film. Prior to making a print, all dust and lint must be removed from the film to prevent that dust and lint from appearing as spots and blemishes on the print. The film cleaner removes these dust and lint particles.

Photographic films are composed of acetates and other similar plastics of high dielectric strength. Hence they will not conduct away static electric charges that are imparted to their surfaces. These charges are easily acquired as the film comes in contact with other plastics, such as the protective plastic containers in which they are kept, other film, or even the same film rolled upon itself. In fact static charges are most often produced on films when attempting to clean them by wiping them with a cloth to remove dust particles.

A static electric charge on a film surface will cause dust particles to adhere to that surface. Most dust particles are also dielectric in nature, and as such tend to readily acquire static surface charges from the absorption of energy from the many radiating sources in the environment as well as from contact with ionized atmospheric gases. Such dust particles will actually be drawn by electrostatic force to a film surface of opposite polarity. Once in contact with a surface dust particles enter into an electrical exchange with that surface which only partially, but not completely, satisfies the neutralization requirements. Although an electrical exchange occurs only locally, at the point where the particle is in contact with the surface of the film, the remainder of the particle still retains its charge and the attractive force which holds it to the surface remains.

Wiping dust from a photographic film will clean it only momentarily, as the static charge on the film will quickly cause more dust to adhere to its surface. And by the time the film has been inserted into the printer it may be equally as dusty as it was before it was wiped.

Film cleaners must control the static charge on the film, as well as remove the dust from its surface, if they are to be effective. This is usually accomplished by a limited variety of methods. One is to remove the static charge by wiping the surface with a conductive liquid that will not attack the photographic emulsion or the film and will quickly evaporate or leave a nondetectable coating. The static charge can also be eliminated by passing the film through an electrically conductive atmosphere, such as that produced by a high humidity environment. An electrically conductive atmosphere of another type, that composed of ionized air, can be produced by nuclear decay components from radio-active materials. Or an ionized atmosphere, of positively and negatively ionized air molecules, can be produced by high voltage electrical means such as is done by Cumming et al, U.S. Pat. No. 4,194,232. Both are very effective in conductively eliminating the static charge on the surface of the film.

In additon to the elimination of the static charge, most film cleaners also remove the dust and lint by convection from high pressure air nozzles. Such devices may be combined in a hand held nozzle as shown by Moulden, U.S. Pat. No. 4,333,123 and Cumming, U.S. Pat. No. 4,213,167, or more often are contained within a jaw-like structure between which the film can be passed, Cumming et al, U.S. Pat. Nos. 4,194,232 and 4,241,377. In this latter concept, the air is activated only as the film is passed between the jaws.

These film cleaners are not capable of cleaning the new disc-film. The new disc-film can be held only by grasping it between the thumb and forefinger by its center hub or holding it lightly diametrically, across its edges, between the thumb and the fingers. It is therefore impractical, if not impossible, to support the disc-film between the jaws of the film cleaner or in the air stream of an air nozzle, with any degree of certainty that the film will be cleaned and not damaged by such a maneuver.

One film cleaner, specifically for disc-film, has been observed, U.S. Patent Pending. However, this device is useful only for the disc-film. It requires that the standard strip-film cleaner be removed and replaced with the disc-film cleaner when disc-film is to be printed. This is not only an inconvenience for film processing lab operators, but also it imposes the additional expense of requiring the acquisition of two complete film cleaners for each printer. The existence of other devices for cleaning disc-film, either as stand alone apparatuses or as apparatuses in conjunction with existing film cleaners, failed to be evidenced by a search of the U.S. patent files.

It is accordingly an objective of the present invention, to provide an attachment for use with strip-film cleaners that will enable these film cleaners to clean disc-film.

It is a further objective of the invention to provide a spindle means for holding disc-film so that it can be inserted into the jaws of the strip-film cleaner.

It is yet another objective of the invention to provide a means for rotating the disc-film within the jaws of the strip-film cleaner.

It is also an objective of the invention to provide a means for actuating the strip-film cleaner, causing it to clean the disc-film, once it is within the jaws of the cleaner.

It is an additional objective of the invention to provide a holding means that firmly affixes the disc-film to the spindle, during the cleaning process, and releases it, for removal, when the process is completed.

Briefly stated, and in accord with the presently preferred embodiments of the invention, a spindle means is provided upon which a disc-film is positioned and locked in place by a holding means. Said spindle is mounted in a plate means, containing bearing means, which provides the spindle with the degree of freedom of axial rotation. Said spindle is coupled to a rotational means which imparts and/or maintains rotational motion to the spindle. Said spindle is provided with a free-wheeling means which permits the rotational motion to persist, as the result of its angular momentum, after the rotational means ceases operation. Further, a release means is provided to unlock the disc-film from the spindle means for removal. Said spindle means, said plate means, said rotational means, and said release means are contained within a housing means such that only the disc-film holding portion of the spindle means and the release means and actuation means project from the housing means. Said housing means is provided with a coupling means and hinge means, which couple it to the film cleaner and permit it to pivot, in a manner proper, to move the spindle means holding the disc-film, so that the disc-film moves into the jaws of the film cleaner. An actuation means is provided which causes the film cleaner to operate when the disc-film is within the jaws.

Several ramifications of the invention can be envisioned utilizing different methods of holding the disc-film. Also many methods are possible for attaching and pivoting the device to insert the disc-film into the film cleaner. Further, there are several alternative design selections for mechanisms to rotate the disc-film. However for practicality, only two embodiments will be discussed in detail. Both embodiments are described as they would be configured for use with a Cumming Corporation Model 3B film cleaner. The first embodiment incorporates a spring mechanism rotational means. The second embodiment utilizes an electric motor rotational means.

For a complete understanding of the invention, together with an appreciation of the objectives and ramifications thereof, please refer to the attached drawings and the following descriptions of the drawings in which.

Figure 1:
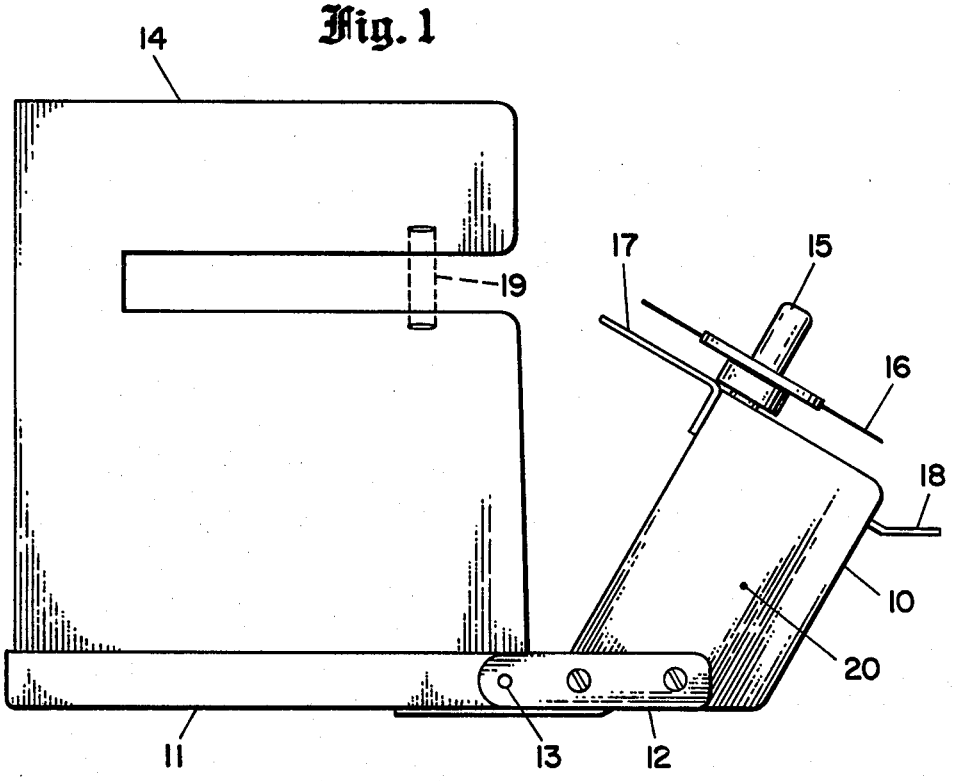
FIG. 1 is a side view of the invention, in the open position, as attached to a film cleaner.

The embodiment of the invention, as shown in FIG. 1, consists of a case means 10 affixed to a base pan 11 by two links 12, one on either side of case means 10. Case means 10 is free to rotate, with respect to base pan 11 about pivots 13. Strip-film cleaner 14 rests closely within and is supported by base pan 11 such that pivot 13 is fixed in location relative to strip-film cleaner 14, and thus case means 10 can rotate on pivots 13 with fixed reference to the strip-film cleaner. Case means 10 visibly supports spindle 15 upon which disc-film 16 rests, and mask 17 and lever 18. Internally case means 10 encloses mechanisms for rotating spindle 15 and release means for disengaging disc-film 16 from spindle 15.

Figure 2:
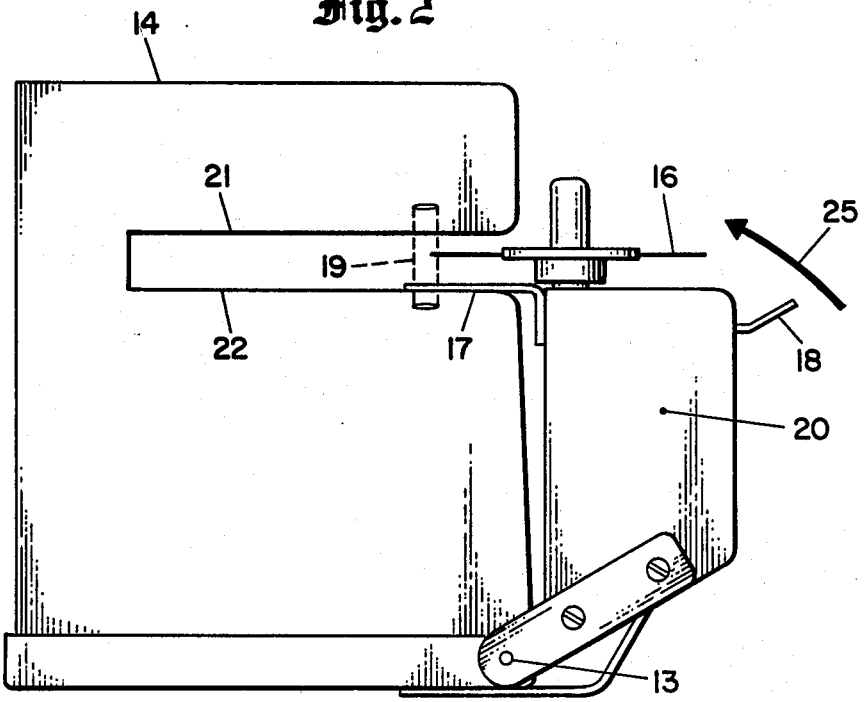
FIG. 2 is a side view of the invention, in the closed position, as attached to a film cleaner.
Figure 3:
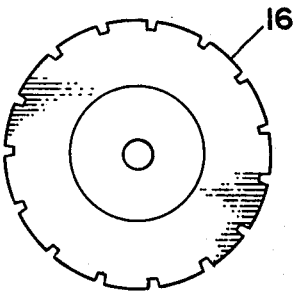
FIG. 3 is a plan view of a disc-film.

In FIG. 1, disc-film mounting arrangement 20 is shown in the open position where disc-film 16 may be either placed on or removed from spindle 15. In FIG. 2, disc-film mounting arrangement 20 is shown in the closed position where it has been rotated about pivots 13 in the direction of arrow 25 by force applied against lever 18 such that disc-film 16 is moved within the jaws 21 and 22 of strip-film cleaner 14. In this position, mask 17 also projects within the jaws 21 and 22, at a precise location, such that it interrupts light beam 19 which activates the film cleaning processes of the strip-film cleaner 14. For the strip-film cleaner envisioned, activation consists of opening a solenoid valve which permits high pressure air to pass through many small jets in the upper and lower jaws and impinge directly upon the disc-film 16, causing any dust to be blown from the surface of disc-film 16 by the convective force of the air emitted from the small jets.

Figure 10:
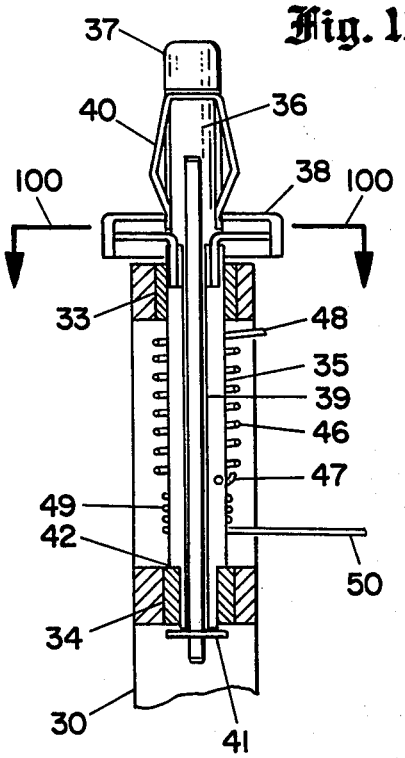
FIG. 10 is a cross-section of the spindle of the first embodiment.
Figure 9:
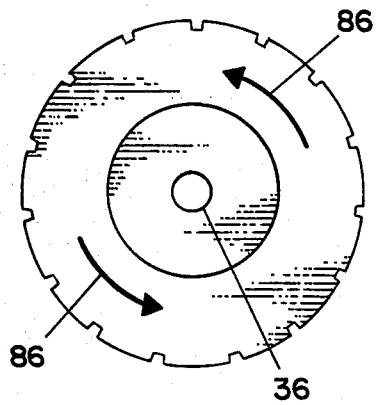
FIG. 9 is a top view of the spindle and disc-film during release of the latch of FIG. 8.
Figure 8:
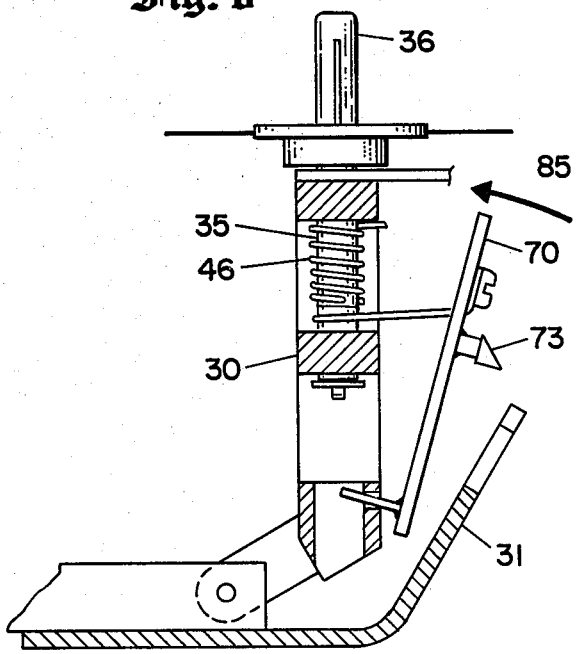
FIG. 8 is a cross-section of the first embodiment along axis 80—80 of FIG. 4 during release of the latch.

The first embodiment of the mechanism for rotating spindle 15 can be understood by observing FIGS. 5, 6, 7, 8, 9, 10 and 11. The spindle is mounted in plate 30 by bearings 33 and 34, which permit it to rotate about axis 32. Referring to FIG. 10, the spindle is comprised of two portions, a tubular portion 35 and the disc holding portion 36. The disc holding portion 36 has a post 37, a drum 38, and a central shaft 39, which are rigidly fitted together such that they react as one integral piece. The central shaft 39 fits loosely into the central bore of tubular portion 35 so that it rotates freely within tubular portion 35. Lock ring 41 about the lower portion of central shaft 39 holds the disc holding portion 36 and the tubular portion 35 together. Moreover, lock ring 41 in combination with step 42 of tubular portion 35 retains the entire spindle assembly within plate 30.

Figure 11:
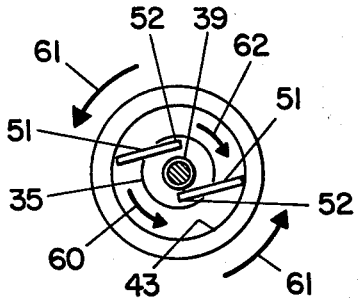
FIG. 11 is a sectional view along line 100—100 of FIG. 10.

Tubular portion 35 supports angle fingers 51 which fit loosely into holes 52 such that their outer arms rotate freely. As shown in FIG. 11, when tubular portion 35 is rotated in the direction of arrow 60, the outer ends of angle fingers 51 engage the inner surface 43 of drum 38 causing it also to rotate in the same direction as indicated by arrows 61.

Referring to FIG. 10, tubular portion 35 is engaged by spring 46, within open area of plate 30, which is attached to the tubular portion at 47 and the plate at 48. In addition line 49 is wrapped several times around the tubular portion and attached also at 47 with free end 50 projecting. The direction of the coil winding of spring 46 and the direction of the wrapping of the line 49 are such that they react in opposition to each other in that the spring resists the rotation of the spindle caused by the pulling of the free end of the line 50. Further, the direction of the wrapping of the line 49 is such that the spindle will rotate in the direction of arrow 62 of FIG. 11 when the free end of the line 50 is pulled. Thusly, pulling the free end of line 50, slowly, a prescribed distance causes the spindle assembly to rotate, slowly, in bearings 33 and 34 and also causes spring 46 to wind up developing a potential torsional force. When the free end of line 50 is released, the torsional force of spring 46 causes the tubular portion 35 to rotate, rapidly, in the direction of arrow 60. This rotation causes fingers 51 to be forced outward and engage drum 38 which imparts a rapid rotation to the disc holding portion of the spindle 36. After the tubular portion 35 has ceased to rotate, the disc holding portion 36 will continue to rotate due to its own angular momentum and the low friction afforded by the loose fit of the shaft 39 in the bore of tubular portion 35 and the disengaging of the fingers 51 for that direction of rotation.

Figure 5:
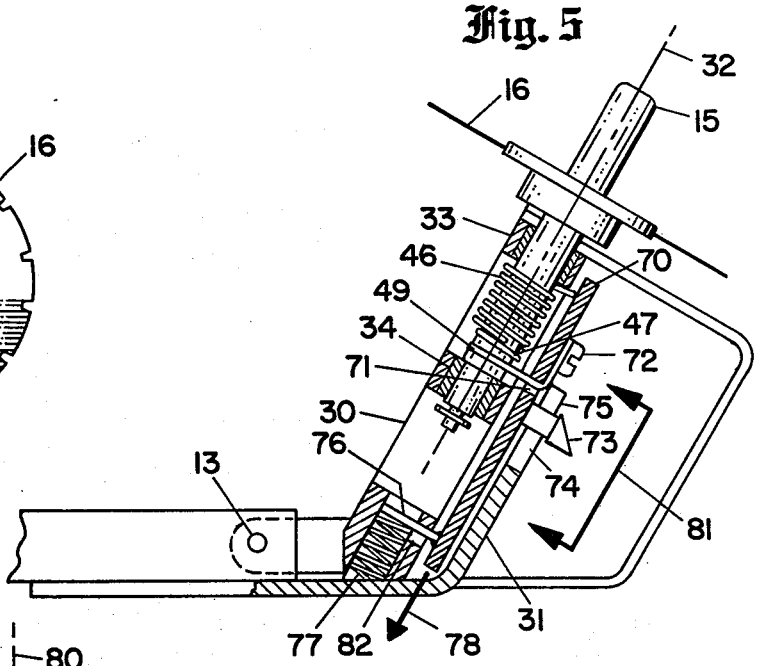
FIG. 5 is a cross-section along axis 80—80 of FIG. 4 of a first embodiment of the invention, in the open position.
Figure 4:
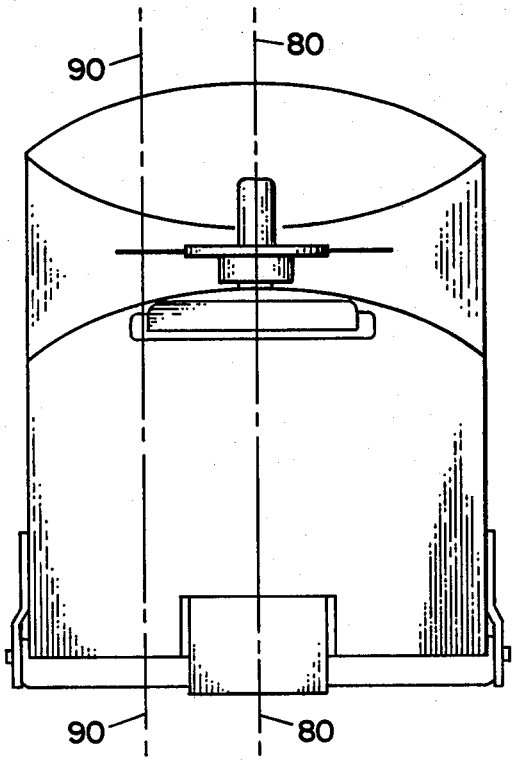
FIG. 4 is an end view, in accordance with the invention, in closed position, as attached to a film cleaner.
Figure 7:
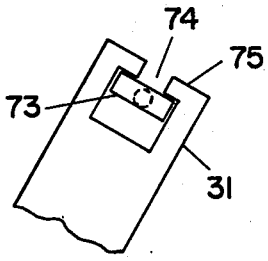
FIG. 7 is a view of a portion of FIG. 5 as indicated by bracketed arrows 81.

Referring to FIGS. 5 and 7, the free end 50 of line 49 passes through hole 71 in free plate 70 and is secured by screw 72. When the disc-film mounting arrangement is moved to the open position, as shown in FIG. 5, latch 73, affixed to free plate 70, passes through slot 74 of angle plate 31 and latches to plate 31 by hooking on to projections 75 of angle plate 31. Free plate 70 can translate downward to enable latch 73 to deflect in the direction of arrow 78 and to hook on to projection 75. Free plate 70 is kept normally in the upward position by the force of spring 77, supported in plate 30, and acting through pin 76 which passes through hole 82 and is attached to free plate 70.

Figure 6:
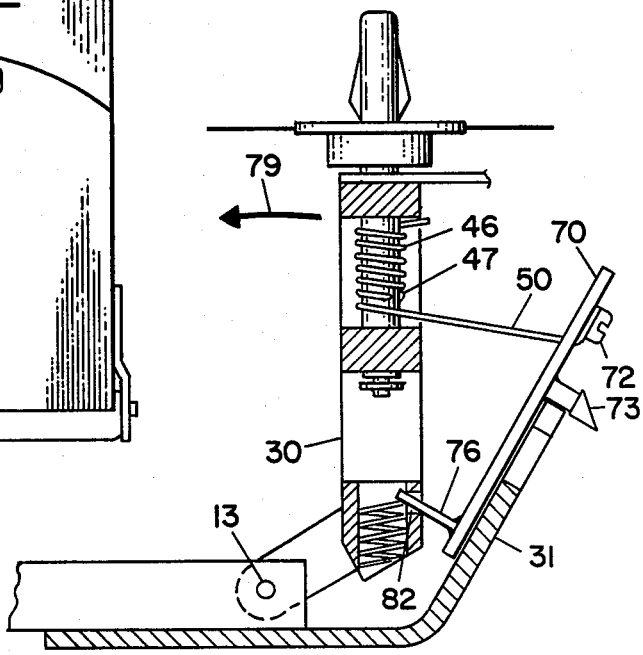
FIG. 6 is a cross-section along axis 80—80 of FIG. 4 of the first embodiment, as the mechanism moved into the closed position.

When the disc-film mounting arrangement is moved into the closed position, as shown in FIG. 2, the plate 30 moves in the direction of the arrow 79 of FIG. 6 as it rotates about pivots 13. By this motion, plate 30 moves away from free plate 70 which is held to angle plate 31 by latch 73. As the distance between plate 31 and free plate 70 increases, line 50 is drawn from tubular portion of spindle 35 causing it to rotate and wind up spring 46. Also as plate 30 moves toward the closed position, pin 76 is carried upward by the relative movement of hole 82 of plate 30, through which pin 76 passes, and angle plate 31. Pin 76 being affixed in free plate 70 carries free plate 70 also in an upward direction which in turn slides latch 73 upward in slot 74 of angle plate 31. When latch 73 reaches the upper limit of angle plate 31, it disengages from angle plate 31 and is free to be drawn rapidly, in the direction of arrow 85 FIG. 8, to plate 30 by the release of the torsional forces stored in spring 46, which also causes a rapid rotation of the tubular portion of spindle 35. Tubular portion 35, thusly, in turn, engages the disc holding portion of the spindle 36 causing it also to rotate rapidly in the direction of the arrows 86 FIG. 9.

Figure 12:
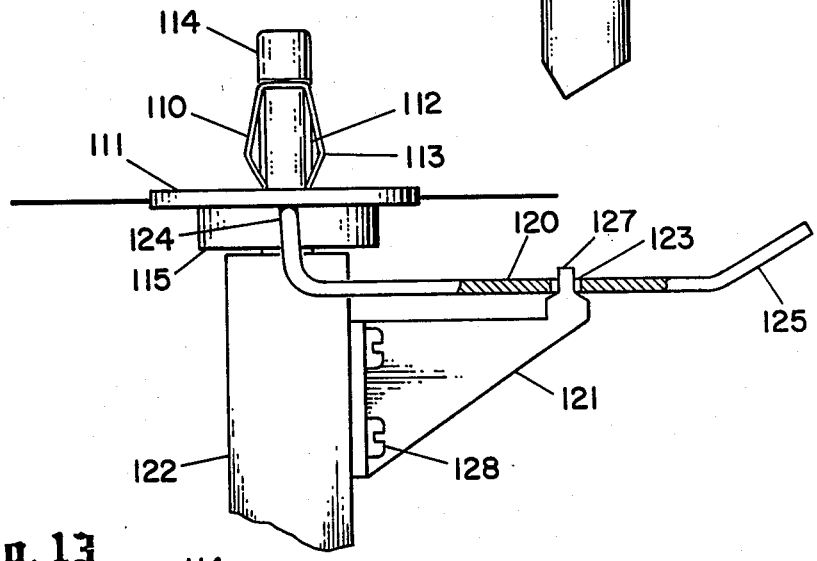
FIG. 12 is a sectional view along line 90—90 of FIG. 4 showing the disc-film in the locked position on the spindle.
Figure 13:
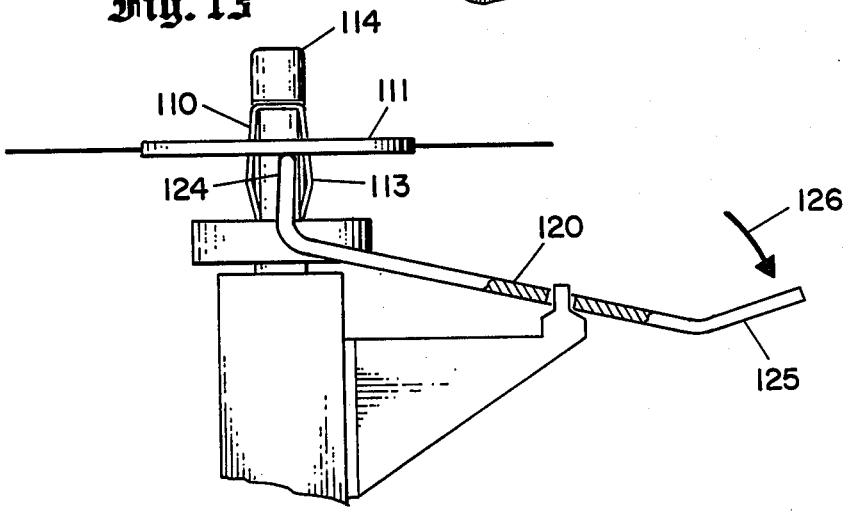
FIG. 13 is the sectional view of FIG. 12 with the disc-film in the released position on the spindle.

Referring to FIGS. 12 and 13, the disc-film is held in place on post 114, of the spindle assembly, by spring-wire 110. The disc-film 111 is placed over the spindle such that post 114 projects up through the hole in the disc-film. Disc-film 111 is then pressed downward causing spring-wire 110 to compress into slot 112 of post 114 until it passes over bend in spring-wire 110. Spring-wire 110 then expands locking disc 111 against the upper surface of drum 115, holding it firmly in place on the spindle. The expansion of spring-wire 110 by its force against the inner surface of the hole in disc-film 111 produces a binding friction which prevents the disc-film from rotating independently of the spindle post. Thus all actions attributed to the upper disc holding portion of the spindle, described earlier, are imparted to the disc-film.

The disc-film 111 is removed from the spindle by the action of lever 120. Lever 120 is supported by brackets 121, of which there are two, attached to plate 122 on either side of the spindle center line by screws 128. Lever 120 has two holes which fit over projections 127 of brackets 121 to form a fulcrum. Lever 120 has two angled extensions 124 which contact the disc-film on either side of the center line when force is applied to end 125 in direction of arrow 126. The application of sufficient force at 125 causes extensions 124 to force disc-film 111 upward and over bend 113 of spring-wire 110 releasing it from the spring-wire so that the disc-film can be lifted off post 114 of the spindle. The lever end 125 is shown projecting from the case means 10 in FIGS. 1 and 2 as lever 18, which also serves as a handle to rotate the disc arrangement into the closed position.

Figure 14:
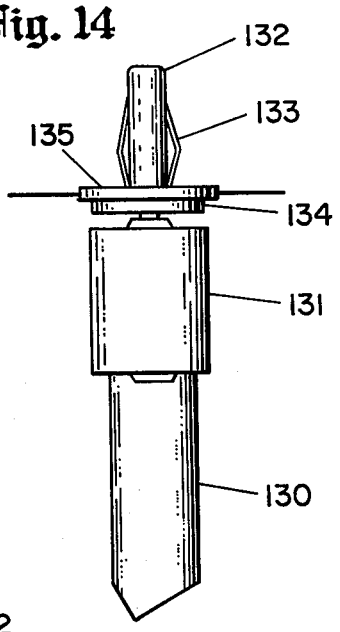
FIG. 14 is a sectional view along axis 80—80 of FIG. 4 of a second embodiment of the invention.

A second embodiment of the invention is shown in FIG. 14. In this embodiment the motivating force for rotating the disc-film is applied by an electric motor 131 supported in plate 130 which replaces plate 30 of FIG. 6. Motor 131 is activated, by electrical connection to the strip-film cleaner, when the disc-film arrangement is moved into the closed position of FIG. 2.

The shaft of motor 131 supports post 132, which is rigidly affixed to it. Post 132 contains spring-wire 133 and disc 134. Disc-film 135 is held to post 132 by the force of spring-wire 133 such that it rotates with the post as the post rotates. Thus, as the disc-film mounting arrangement is moved into the closed position, such that the disc-film is placed between the jaws of the strip-film cleaner, the system is activated and the disc-film is rotated and cleaned.

While the principles of the invention are thus disclosed and two embodiments are described in detail, it is not intended that the invention be limited to these embodiments. It is recognized that many modifications will occur to those skilled in the art which lies within the spirit and the scope of the invention. It is intended that the invention cover such modifications and be limited in scope only by the appended claims.

What is claimed is:

1. The combination of: A film cleaner, for cleaning strip-film, having jaws containing air jet means, electrostatic surface-charge neutralizing means and other means for removing dust from the surface of film, and: A disc film mounting arrangement for holding and passing disc-film through the jaws of the film cleaner is a manner such that the disc-film will be acted upon and cleaned by the film cleaner, said mounting arrangement having a spindle means upon which disc-film can be positioned, a holding means which clamps the disc-film to the spindle means, a plate means for mounting said spindle means, a rotating means for providing axial rotation of said spindle means, a release means for releasing the disc film from the spindle means, a case means for containing and supporting the components of the arrangement, a coupling means for attaching the arrangement to the film cleaner, a hinge means for pivoting the arrangement such that the disc-film positioned on the spindle means will pass between the jaws of the film cleaner, and an actuation means that causes the film cleaning means to operate when the disc-film is moved within the jaws of the film cleaner.

2. The combination as specified in claim 1 wherein said spindle means is comprised of upper and lower axially aligned portions rotationally independent of each other, said upper portion containing the disc holding means and said lower portion incorporating the rotational means, said lower portion being coupled to the upper portion by a free-wheeling means which engages the upper portion when the lower portion is rotating in a prescribed direction and disengages the upper portion when the lower portion is not rotating thus permitting the upper portion to continue to rotate by reason of its own inertia after the rotation of the lower portion has ceased.

3. The combination as specified in claim 1 wherein said release means is comprised of a lever means positioned over a fulcrum means which supports the lever means near its center, said fulcrum means being mounted on said plate means which support said spindle means, said lever means having a first end to which manual force can be applied and having a second opposite end supporting two projections which contact diametrically opposite locations on the under side of the center hub of the disc-film mounted on the spindle means when force is applied, said force causing the disc-film to move upward and off the spindle.

4. The combination as specified in claim 1 wherein said coupling means is comprised of a base means, to which the film cleaner is attached or positioned fixing its spatial location, having two attaching means, one on either side below the open end of the film cleaner jaws, to which two arms extending from the case means engage, and about which said case means is free to pivot, said pivoting following prescribed geometric relations such that the disc-film mounted on the spindle means will pass unobstructed into and out of the jaws of the film cleaner.

5. The combination as specified in claim 1 wherein said rotating means is an electric motor coupled to the spindle means such that the rotation of the electric motor rotates the spindle means, said electric motor being connected by electrical circuitry to the circuitry of the film cleaner such that activation of the film cleaner also induces the activation of the electric motor.

6. The combination as specified in claim 1 wherein the spindle means comprises a cylindrical post upon which the disc-film is positioned and wherein the holding means is a spring wire which passes transversely through the center of the post and folds down within grooves along either side of the post terminating in a disc affixed about the post, with a bend in the spring-wire midway in each side such that the spring-wire stands away from the post, said wire being compressed by the hole in the disc-film as the disc-film is placed on the post and expanding as the disc-film passes beyond the bends in the spring-wire, said action holding the disc-film firmly against the disc affixed to the post and binding against the inward surface of the hole in the disc-film such that the disc-film is rigidly coupled to the post of the spindle means.

7. The combination as specified in claim 1 wherein the rotating means consists of a torsional spring about a lower portion of the spindle means, one end of said torsional spring being affixed to the lower portion of the spindle means and the other end being affixed to the plate means for mounting the spindle means said lower portion also having a winding means comprising a line, one end of said line is affixed to the lower portion of the spindle means and the other end to a latching means, drawing on the line rotates the spindle means against the reaction of the torsional spring storing rotational energy in the torsional spring, said latching means coupling the winding means to the manual action of moving the disc-film mounting arrangement into the jaws of the film cleaner by reason of the latching means, said latching means comprising a plate with a slot and a latch, said plate being affixed to and remaining stationary with the jaws of the film cleaner, said latch sliding within the slot of the plate and drawing on the line as the mounting arrangement is moved into the jaws of the film cleaner to where the mounting arrangement has reached a position where the disc-film has arrived at a prescribed position within the jaws, as determined by the termination of the slot in the plate, which permits the latch to move over out of the slot and be released from the plate, thus uncoupling the line from the mounting arrangement, said uncoupling allowing the line to be withdrawn from the plate thereby releasing the stored rotational energy of the torsional spring, said rotational energy being transferred to the lower portion of the spindle, causing the lower portion to rotate rapidly in a prescribed direction, said lower portion being coupled to the upper disc-film holding portion of the spindle means causing the upper portion to rotate.

8. The combination as specified in claim 1, and wherein the film cleaner is caused to operate by the interruption of a light beam which passes between the jaws of the film cleaner, the actuation means is comprised of a flat opaque projection, extending from the case means of the attachment arrangement, which moves into the light beam causing the film cleaner to operate when the case means is positioned such that the disc-film positioned on the spindle means, is within the jaws of the film cleaner.

9. The combination as specified in claim 1 and wherein the film cleaner is caused to operate by the closing of an electrical circuit of the film cleaner, the actuation means is comprised of an electric switch means interconnecting with the electrical circuitry of the film cleaner such that closing the switch means activates the film cleaner, said switch means affixed so that the relative motion between the disc-film mounting arrangement and the film cleaner causes the switch means to close when the disc-film, positioned on the spindle means, is moved within the jaws of the film cleaner.

* * * * *